US005138375A

United States Patent [19]

Iimori

[11] Patent Number: 5,138,375

[45] Date of Patent: Aug. 11, 1992

[54] IMAGE FORMING APPARATUS

[75] Inventor: Akiro Iimori, Yokohama, Japan

[73] Assignee: Kabushiki Kaisha Toshiba, Kawasaki, Japan

[21] Appl. No.: 565,141

[22] Filed: Aug. 10, 1990

[30] Foreign Application Priority Data

Aug. 25, 1989 [JP] Japan ..... 1-219403

[51] Int. Cl.[5] ..... G03G 21/00

[52] U.S. Cl. ..... 355/202; 165/40; 355/200; 355/204; 355/208

[58] Field of Search ..... 355/202, 282, 203-204, 355/208, 215, 209, 133; 219/216; 236/49.3; 165/40; 123/41.12

[56] References Cited

U.S. PATENT DOCUMENTS 4,585,319 4/1986 Okamoto et al. ..... 355/200
4,756,473 7/1988 Takemae et al. ..... 236/49.3
4,903,072 2/1990 Iwata .
4,919,195 4/1990 Tanino ..... 165/40 X
4,952,982 8/1990 Tabuchi et al. ..... 355/206 X
4,955,431 9/1990 Saur et al. ..... 165/40 X

FOREIGN PATENT DOCUMENTS 2615969 12/1988 France .
0100463 6/1984 Japan .
0262883 11/1987 Japan .
0065471 3/1988 Japan .

*Primary Examiner*—A. T. Grimley
*Assistant Examiner*—Matthew S. Smith
*Attorney, Agent, or Firm*—Foley & Lardner

[57] ABSTRACT

An image forming apparatus having a cooling fan, driven at a constant rotational speed while the apparatus is performing a copying operation. The fan changes the rotational speed in accordance with the temperature within the apparatus while the apparatus is in a standby condition. Therefore, the fan makes little noise, without causing a decrease in the operating efficiency of the apparatus which may result from a temperature rise within the apparatus.

5 Claims, 12 Drawing Sheets

IMAGE FORMING APPARATUS

BACKGROUND OF THE INVENTION

1. Field of the Invention

The present invention relates to an image forming apparatus such as an electronic copying apparatus, which has a cooling fan for preventing an excessive temperature rise within the apparatus.

2. Description of Related Art

Most electronic copying apparatuses have many components (e.g., an exposure lamp) which consume much electric power. The electric power of the apparatus consumes during operation amounts to about 1.5 KW. Part of the power consumed changes to heat, which raises the temperature within the apparatus. If the temperature is excessively high, it will damage to some of the components of the apparatus. To prevent such damages, a cooling fan is incorporated in the apparatus and is rotated at speed as high as approximately 2400 rpm, thereby maintaining the temperature below a specific value. The noise, which the fan makes while rotating, is great, annoying those working near the copying apparatus.

The period of time the copying apparatus remains in the standby condition is much longer than the period the apparatus is performing a copying operation. The copying apparatus is operated to copy originals from time to time, each time for a relatively short period. Thus, in the prior art, the cooling fan is rotated at a lower speed while the apparatus is in the standby condition, whereby a requirement for reducing the noise can be realized to some degree.

Although the copying apparatus makes less noise while set in the standby condition, it still makes noise. Even if the cooling fan is rotated during the standby period at the speed half that value during the copying period, the noise cannot be decreased as much as is desired by the people working near the apparatus. To decrease the noise as much as desired, various attempts have been made. More specifically, the cooling fan is rotated at a still lower speed, or it is stopped at all. Nonetheless, no satisfactory results have been attained. This is because the fan must have one cooling efficiency right after a copying operation and another cooling efficiency some time after the copying operation since, due to the heat capacity and time constant of the apparatus, the temperature and temperature distribution which the apparatus has immediately after a copying operation are different from those which the apparatus has some time after a copying operation. This is also because the efficiencies (i.e., the rotational speeds) required of the fan for cooling the heat-generating components are different because of the heat capacities of these components and the positions thereof with respect to the fan.

SUMMARY OF THE INVENTION

Accordingly it is the object of the present invention to provide an image forming apparatus in which the cooling means makes as little noise as is desired without causing a temperature rise within the apparatus which may decrease the operating efficiency of the apparatus.

In order to achieve the above object, according to this invention, there is provided an image forming apparatus for forming image information obtained by reading an image of an original, said apparatus comprising:

means for cooling heat-generating components:

means for driving said cooling means; and means for controlling said drive means, thereby to drive said cooling means at a substantially constant speed during an image forming period and to drive said cooling means during a standby period at a varying speed.

Since the control means changes the speed of the cooling means during the standby period in accordance with the temperature within the apparatus, the noise the cooling means makes during the standby period can be minimized.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

There will be described embodiments of this invention with reference to the accompanying drawings.

Figure 1:
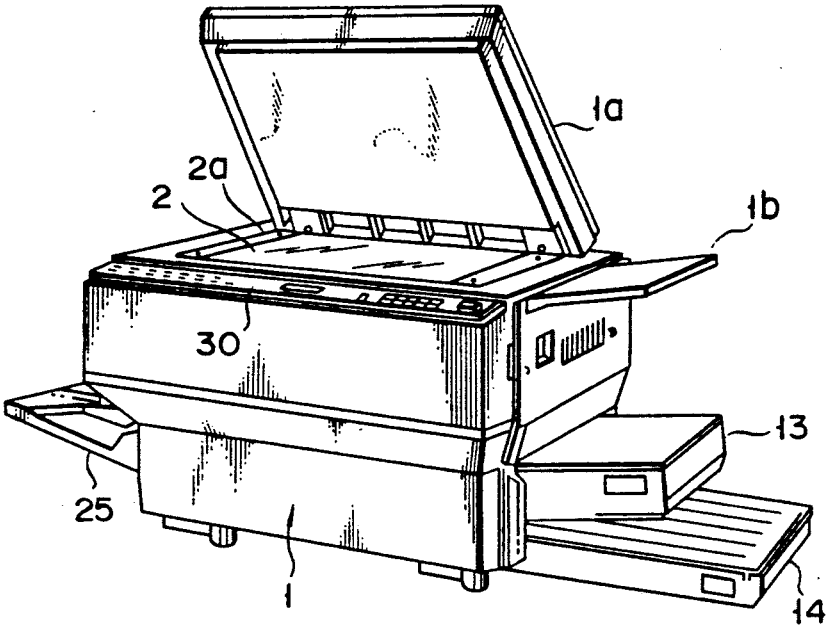
FIG. 1 is a perspective view showing an electronic copying apparatus according to a first embodiment of this invention.
Figure 2:
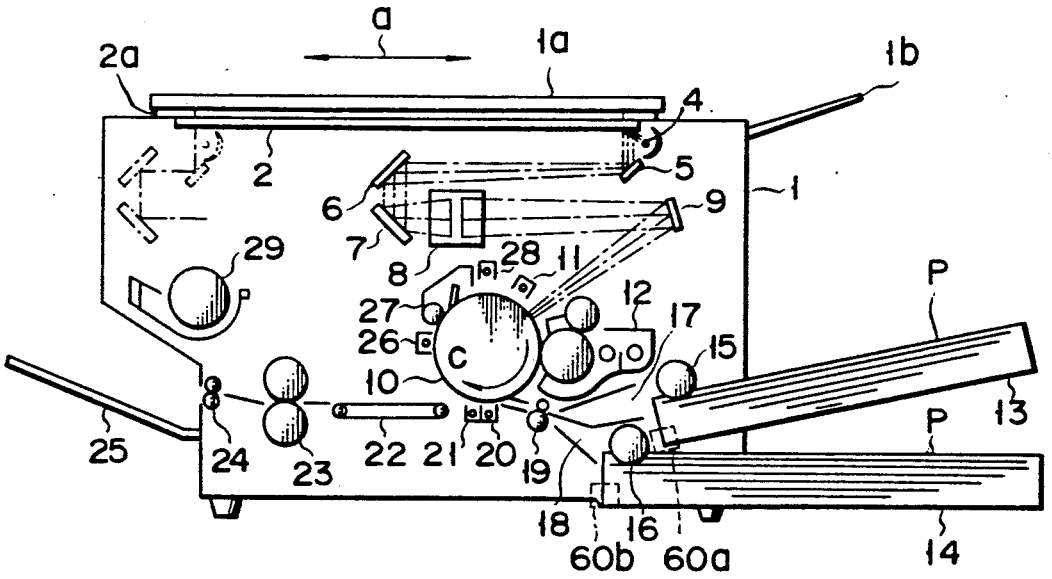
FIG. 2 is a sectional side view illustrating the electronic copying apparatus show in FIG. 1.

FIGS. 1 and 2 are a perspective view and a sectional side view of an electronic copying apparatus, which is a first embodiment of the present invention. The electronic copying apparatus comprises a main body 1 and an original table (a transparent glass plate) 2 defining the top of the apparatus. A scale 2*a* fixed on the table 2, for facilitating the registering of an original. An original cover la is hinged to one side of the original table 2 and can be opened and closed. A work table 1*b* horizontally extends from another side of the original table 2. The copying apparatus further comprises an optical system located within the main body 1 below the original table 2. The optical system includes an exposure lamp 4 and mirrors 5, 6, and 7. The optical system can be moved along the original table 2, back and forth in the directions of arrow a as is shown in FIG. 2 to scan the original placed on the original table 2. The mirrors 6 and 7 are moved at half the speed of the mirror 5, in order to maintain an optical path at a fixed length. The light reflected from the original is reflected by the mirrors 5, 6, and 7, passes through a magnification varying lens block 8, is reflected by a mirror 9, and is applied to a photosensitive drum 10, whereby the image on the original is focused on the surface of the photosensitive drum 10.

As the photosensitive drum 10 is rotated in the direction of an arrow c (FIG. 2), its surface is electrically charged by a discharger 11. Then, the surface of the drum 10 is exposed to the light reflected from the mirror 9. As a result, an electrostatic latent image corresponding to the image formed on the original is formed on the surface of the surface of the photosensitive drum 10. As the drum 10 is further rotated in the direction of the arrow c, a developer 12 applies toner to the surface of the drum 19, thus changing the latent image into a visible image.

A feed roller 15 or 16 is rotated, thus supplying a paper P of recording paper one by one from an upper paper feed cassette 13 or a lower paper feed cassette 14 which is loaded into the main body 1 from one side thereof. Each paper P supplied from the cassette 13 or 14 is guided through a paper guide passage 17 or 18 to a pair of regist rollers 19 and then through the gap between the rollers 19, and is guided to an image transfer section. The paper feed cassettes 13 and 14 are removably provided at the lower portion on the right hand side of the main body 1. Any one of the cassettes 13 and 14 can be selected by operating the operation panel to be mentioned later. The size of the cassette 13 and 14 can be detected by cassette size sensing switches 60*a* and 60*b*, respectively. Each of the sensing switches is comprised of a plurality of microswitches which are selectively turned on when the cassette is loaded into the main body 1, and are turned off when the cassette is withdrawn from the main body 1.

The paper P fed to the image transfer section is brought into contact with the surface of the photo sensitive drum 10 at the portion of a transfer charger 20 so that the toner image on the photosensitive drum 10 is transferred from the photo sensitive drum 10 to the paper P by the action of the charger 20. The image-transferred paper P is separated from the photo sensitive drum 10 electorostatically by a separating charger 21 and is carried by a paper carrying belt 22 to a pair of fixing rollers 23 which are provided at the end of the belt 22. When the paper P passes through the paired fixing rollers 23, the transferred image is fixed to the paper P. The paper P, with the image fixed, passes a pair of paper-discharging rollers 24 and is discharged onto an outlet tray 25 located outside of the main body 1.

After the image transfer is completed, the photosensitive drum 10 is discharged by means of a discharger 26. Thereafter, the residual toner is removed from the surface of the photosensitive drum 10 by a cleaner 27. Then, the residual image on the surface of the photosensitive drum 10 is erased by a discharge lamp 28. As a result of this, the photosensitive drum 10 is restored to the initial state. A cooling fan 29 is located within the main body 1, and is driven by a fan-driving motor (later described) to prevent an excessive rise in the temperature within the main body 1.

Figure 3:
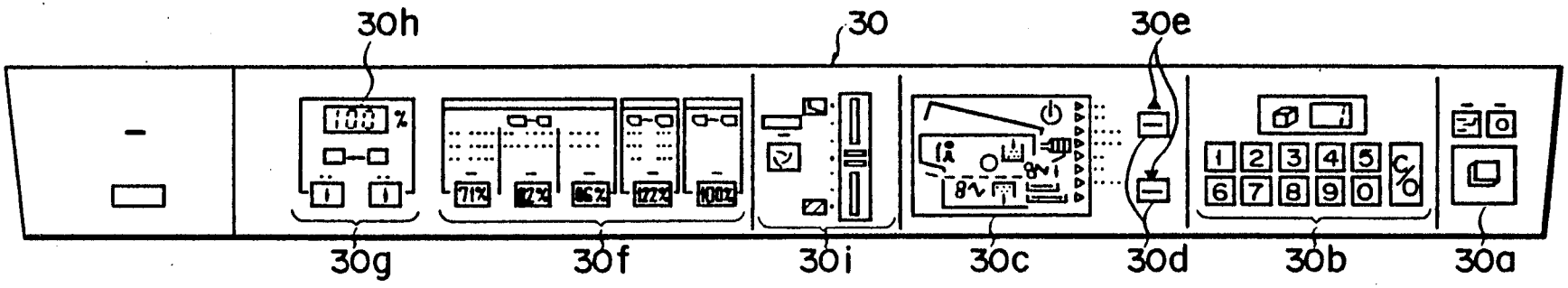
FIG. 3 is a plan view of the operation panel of the copying apparatus shown in FIG. 1.

FIG. 3 is a plan view illustrating the operation panel 30 arranged on the top of the main body 1. The panel 30 includes a copy key 30*a* for instructing a start of a copying operation, a ten-key 30*b* for inputting a numerical value such as the number of copies to make, a display 30*c* for displaying the operating condition of each section and the occurrence of jamming of the paper, a cassette select key 30*d* for selecting one of the upper and lower paper feed cassettes 13 and 14, a cassette display 30*e* for displaying the paper feed cassette selected by the cassette select key 30*d*, magnification changing keys 30*f* for setting the enlarging and reducing magnification of a copy within the predetermined relationships, zoom keys 30*g* for continuously setting the enlarging and reducing magnification of a copy, a magnification display 30*h* for displaying the enlarging/reducing magnification set by the operation of the keys, and a copy density setting keys 30*i* for selecting the density in which an original image is to be copied.

Figure 4:
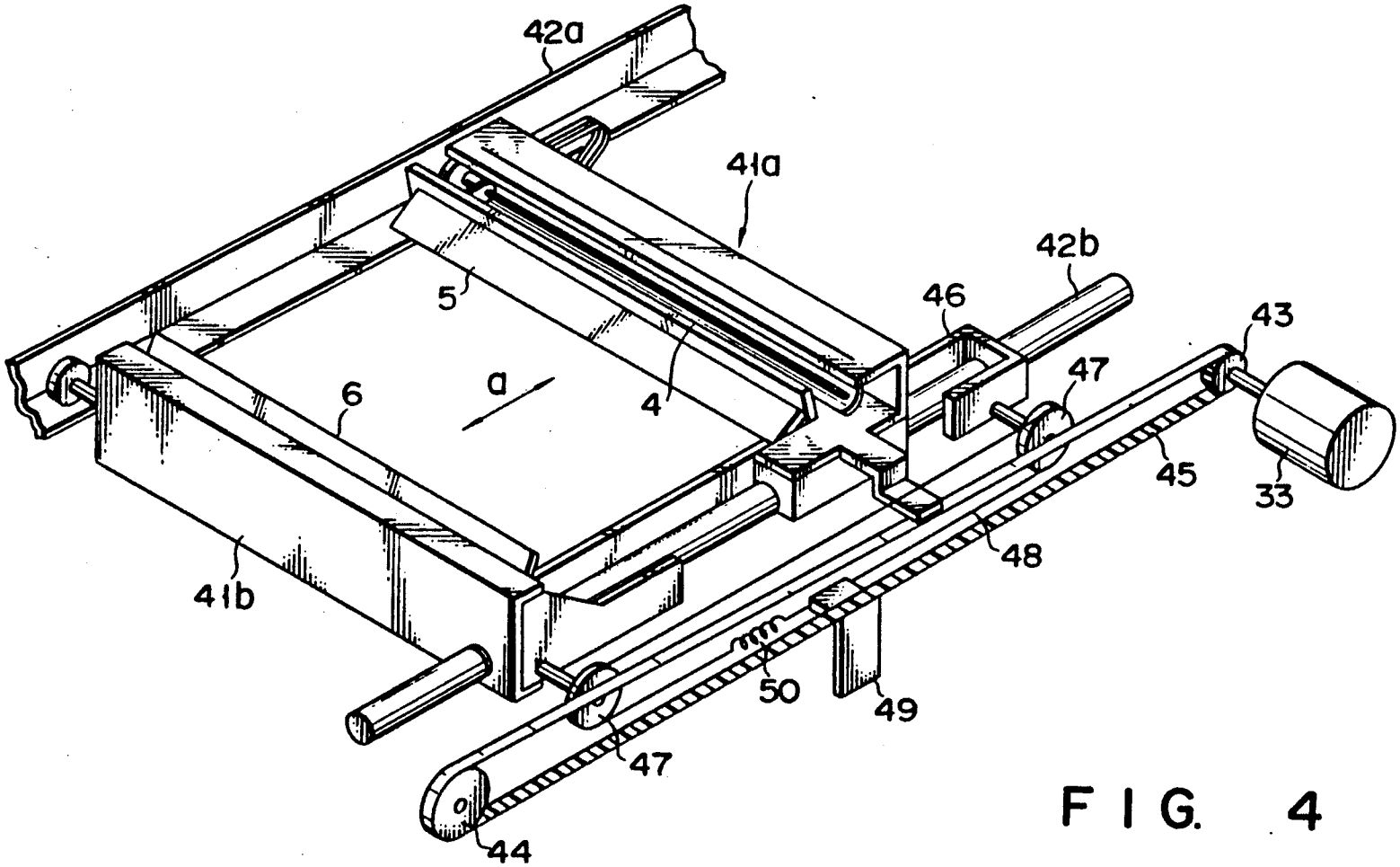
FIG. 4 is a perspective view schematically representing the drive mechanism incorporated in the copying apparatus of FIG. 1, for driving the optical system also used in the apparatus.

FIG. 4 is a perspective view illustrating a driving mechanism for moving the optical system back and forth. The mirror 5 and the exposure lamp 4 are supported by a first carriage 41*a*, and the mirrors 6 and 7 are supported by a second carriage 41*b*. The carriages 41*a* and 41*b* can be moved in parallel to each other in the directions of arrows a, guided by guide rails 42*a* and 42*b*. A four-phase pulse motor 33 drives a pulley 43. An endless belt 45 is provided between the pulley 43 and an idler pulley 44. The first carriage 41*a*, which supports the mirror 5, is fastened at one end to an intermediate point of the endless belt 45.

The second carriage 41*b*, which supports the mirrors 6 and 7, has a guide portion 46. A pair of pulleys 47, 47 are provide swingably for this guide portion 46 such that they are spaced apart in the axial direction of the rail 42*b*. A wire 48 is wound around these pulleys 47, 47. One end of the wire 48 is fastened to a fixed member 49, and the other end thereof is also connected to the fixed member 49 through a coil spring 50. One end of the first carriage 41*a* is fixed to an intermediate point of the wire 48. With this construction, when the pulse motor 33 is rotated, the endless belt 45 is driven, thus moving the first carriage 41*a*, and ultimately moving the second carriage 41*b*. Since the pulleys 47, 47 function as movable pulleys at this time, the second carriage 41*b* moves at half the speed of the first carriage 41*a*, in the same direction as the first carriage 41*a*. The moving direction of the first and second carriages 41*a* and 41*b* can be changed by reversing the rotation of the pulse motor 33.

Next, a first embodiment of the present invention will now be described with reference to FIGS. 5 to 8.

Figure 5:
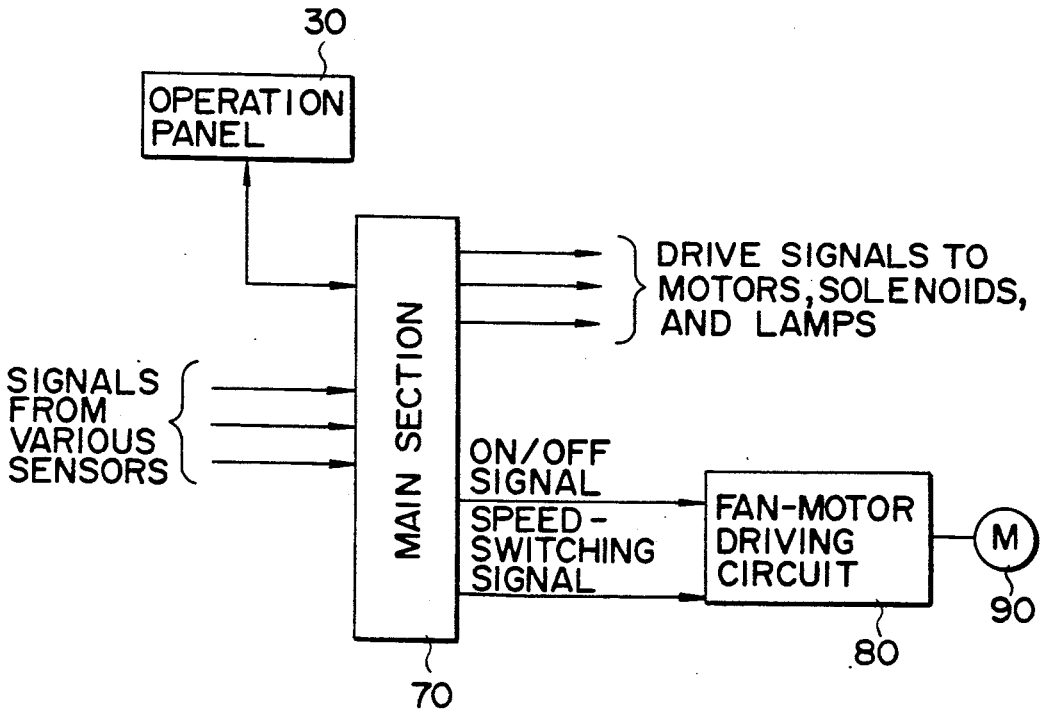
FIG. 5 is a block diagram showing the major components of the control system incorporated in the electronic copying apparatus illustrated in FIG. 1.

FIG. 5 is a block diagram schematically illustrating an arrangement of a main portion of a control system used in the first embodiment. In FIG. 5, the control system comprises a main control section 70 which controls the main body 1 of the copying apparatus as a whole and includes a CPU (Central Processing Unit) among other things. The main control section 70 receives various signals such as the key input signals input from the operation panel 30 and the detection signals produced by the various sensors (not shown). In response to these signals, the main control section 70 outputs display control signals to be supplied to the operation panel 30 and various kinds of driving signals used for driving the four-phase pulse motor 33 for moving the optical system back and forth, the other motors, the solenoids, the exposure lamp 4, etc. The main control section 70 also outputs an on/off signal which turns on or off a fan motor 90 for the cooling fan 29 and a speed-switching signal which changes the rotation of the cooling fan 29 at a high or low speed, to the cooling fan-motor driving circuit 80.

Figure 6:
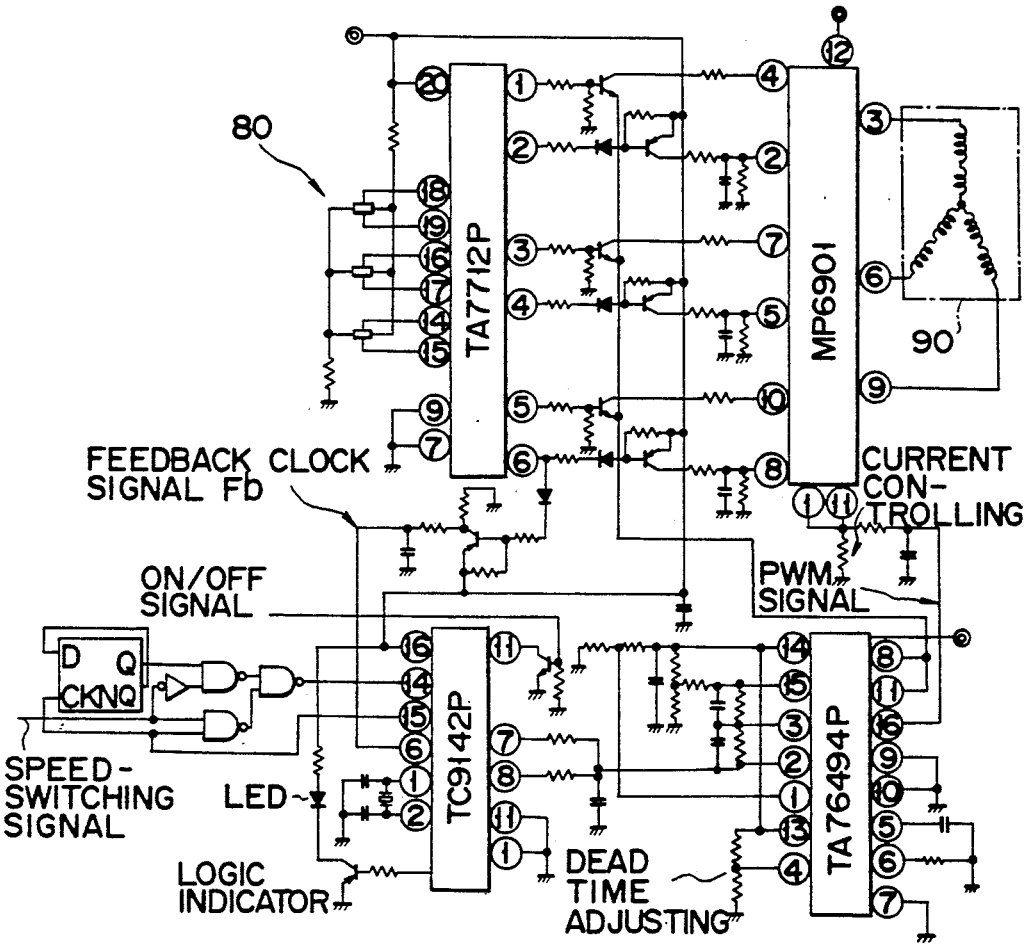
FIG. 6 is a circuit diagram showing the fan-motor driving circuit incorporated in the control system shown in FIG. 5.

FIG. 6 is a circuit diagram showing an arrangement of a fan-motor driving circuit 80. As is illustrated in FIG. 6, the driving circuit 80 receives the on/off signal at the on-level from the main control section 70 to drive the fan motor 90. A PLL IC (Phase Locked Loop Integrated Circuit) TC9142P rotates the motor 90 at a constant speed. More specifically, the driving circuit 80 drives the fan motor 90 such that the cooling fan 29 rotates at a speed of 2400 rpm, when the speed-switching signal supplied from the main section 70 is at a high level, and at a speed of 1200 rpm when the speed-switching signal is at a low level.

Figure 7:
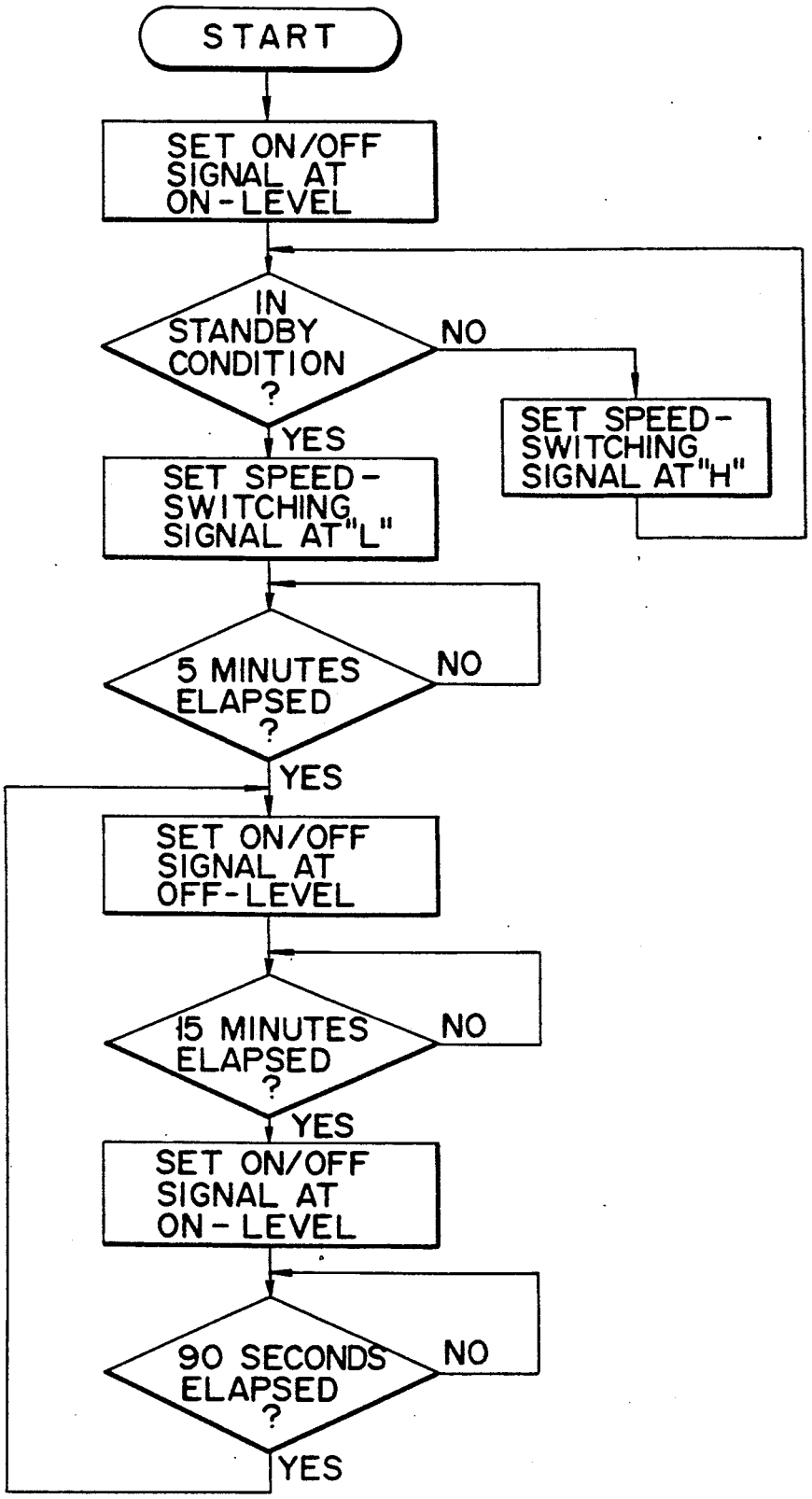
FIG. 7 is a flow chart explaining the operation of the control system shown in FIG. 5.
Figure 8:
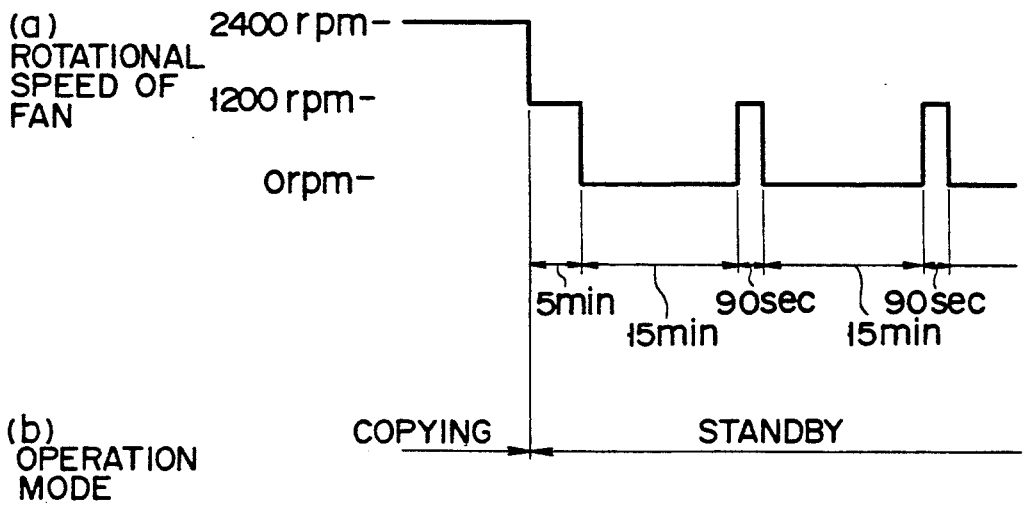
FIG. 8 is a timing chart, also explaining the operation of the control system shown in FIG. 5.

With reference to the flow chart and the timing chart illustrated in FIGS. 7 and 8, it will be explained how the cooling fan 29 is controlled in the electronic copying apparatus according to the first embodiment of the present invention. When the main switch (not shown) of the apparatus is turned on, the main control section 70 sets the on/off signal at the on-level. The on/off signal at the on-level is supplied to the fan-motor driving circuit 80. Then, the main control section 70 determines whether or not the copying apparatus is in the standby condition for copying operation, that is, whether or not the copy key 30*a* has been operated. If YES, the motors, the solenoids, and the exposure lamp 4 are driven. The apparatus therefore performs a copying operation in the manner described above. At the same time, the main section 70 sets the speed-switching signal at the high (H) level, and the speed-switching signal at the high level is supplied to the fan-motor driving circuit 80.

If the main body 1 of the copying apparatus is performing a copying operation, that is, if the main control section 70 has supplied the on/off signal at the on-level and the speed-switching signal at the high level to the fan-motor driving circuit 80, the fan motor 90 is driven at the high speed by the fan-motor driving circuit 80. As a result, as shown in FIG. 8, the cooling fan 29 is rotated at the speed of 2400 rpm, which gives the largest cooling capacity during a copying operation.

When the main control section 70 determined in accordance with the judgement of the operation mode that the main body 1 of the copying apparatus is changed from the copying operation to the standby condition, the control section 70 sets the speed-switching signal at the low (L) level. The speed-switching signal L is supplied to the fan-motor driving circuit 80. The driving circuit 80 therefore drives the fan motor 90 at the low speed. As a result, as shown in FIG. 8, when the temperature within the main body 1 is higher than the normal temperature for the standby condition, during the standby period and immediately after the completion of the copying operation, the cooling fan 29 is rotated at the speed of 1200 rpm for a predetermined time of, for example, 5 minutes, until the temperature within the main body 1 falls to the normal temperature for the standby condition.

Upon lapse of 5 minutes, the main control section 70 sets the on/off signal at the off-level. The on/off signal is supplied to the fan-motor driving circuit 80. The driving circuit 80 stops the drive of the fan motor 90. Therefore, the cooling fan 29 is stopped during the standby period when the temperature within the main body 1 is equal to or less than the normal temperature for the standby condition.

Unless the cooling fan 29 is rotated while the apparatus is in the standby condition, the temperature within the main body 1 gradually rises since the fixing rollers 23 and the like are still radiating heat. To prevent such a temperature rise, the main control section 70 sets the on/off signal at the on-level upon lapse of every 15 minutes and maintains the signal at the on-level for 90 seconds, for example. The fan motor 90 is therefore driven for 90 seconds every 15 minutes. As a result, as is shown in FIG. 8, the cooling fan 29 is rotated for 90 seconds every 15 minutes as long as the main body 1 of the copying apparatus remains in the standby condition. In this case, the rotation of the fan 29 is set at 1200 rpm since the speed-switching signal supplied from the main control section 70 to the fan-motor driving circuit 80 is at the low level. Although not specified in FIG. 8, the main control section 70 watches, at all times during the standby period, whether or not the copy key 30*a* is operated to start the copying operation.

As may be understood from the above, (1) the cooling fan 29 is rotated at 2400 rpm during the copying operation at the largest cooling capacity to decrease the temperature within the main body 1; (2) the fan 29 is rotated at 1200 rpm until the temperature falls to the normal temperature for the standby condition when the temperature of the main body 1 is higher than the normal temperature immediately after the completion of the copying operation; (3) the fan 29 is thereafter rotated periodically, each time for a predetermined period of time, when the temperature within the main body 1 is not so high. In other words, the minimum cooling capacity which needs to drive the fan 29 is only required during the standby period after the main body 1 is sufficiently cooled down.

Therefore, the noise which the cooling fan 29 makes during the standby period is reduced. The heat generated during the standby period is not intense enough to do damages to some of the components of the copying apparatus. Nor are the components, such as lenses or mirrors, cooled to be wetted by condensation and dirtied with dust. In the first embodiment, the noise made by the cooling fan 29 can be satisfactorily lowered, without damaging the components, deteriorating the quality of the copied image, or reducing the copying efficiency. Furthermore, the electronic copying apparatus consumes but less electric power than the conventional electronic copying apparatus.

A second embodiment of the present invention will now be described with reference to FIGS. 9 to 12.

Figure 9:
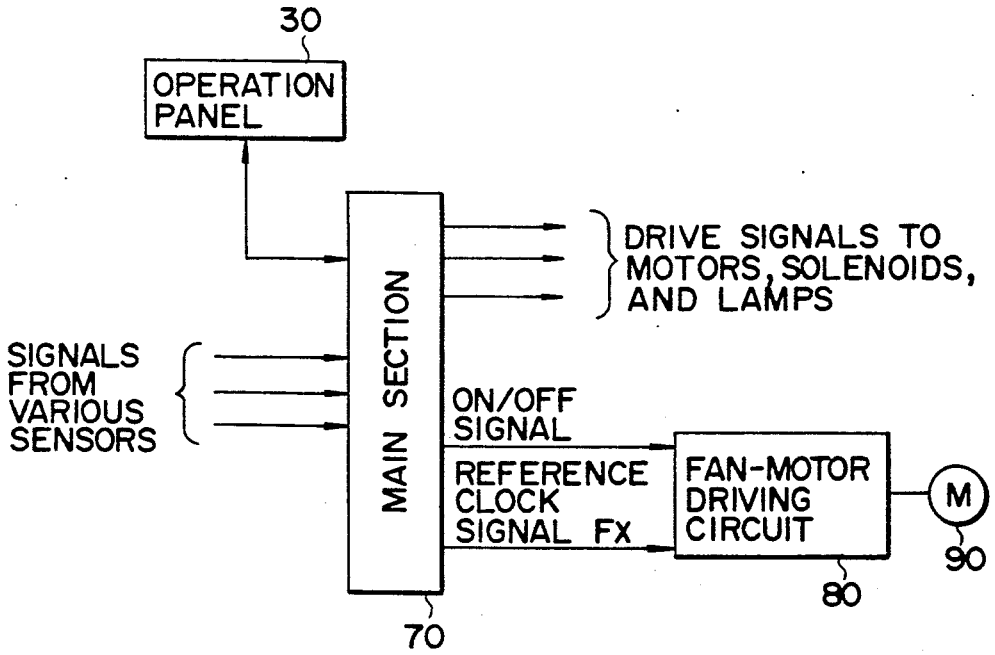
FIG. 9 is a block diagram showing the major components of the control system incorporated in an electronic copying apparatus according to a second embodiment of the present invention.

FIG. 9 is a block diagram schematically illustrating a main portion of a control system used in this second embodiment. This control system differs from the system of FIG. 5, in that the main control section 70 supplies an on/off signal and a reference clock signal Fx to the fan-motor driving circuit 80. The on/off signal turns a fan motor 90 on and off. The reference clock signal Fx changes the rotational speed of the fan motor 90 and, hence, that of the cooling fan 29. The rotational speed of the cooling fan 29 is changed by changing the frequency of reference clock signal Fx, which determines the rotational speed of the fan motor 90, as shown in the following equation:

$$\textit{Rotational speed (rpm) of the motor } 90 = 4 \times 60 \times Fx \ (Hz)$$

Figure 10:
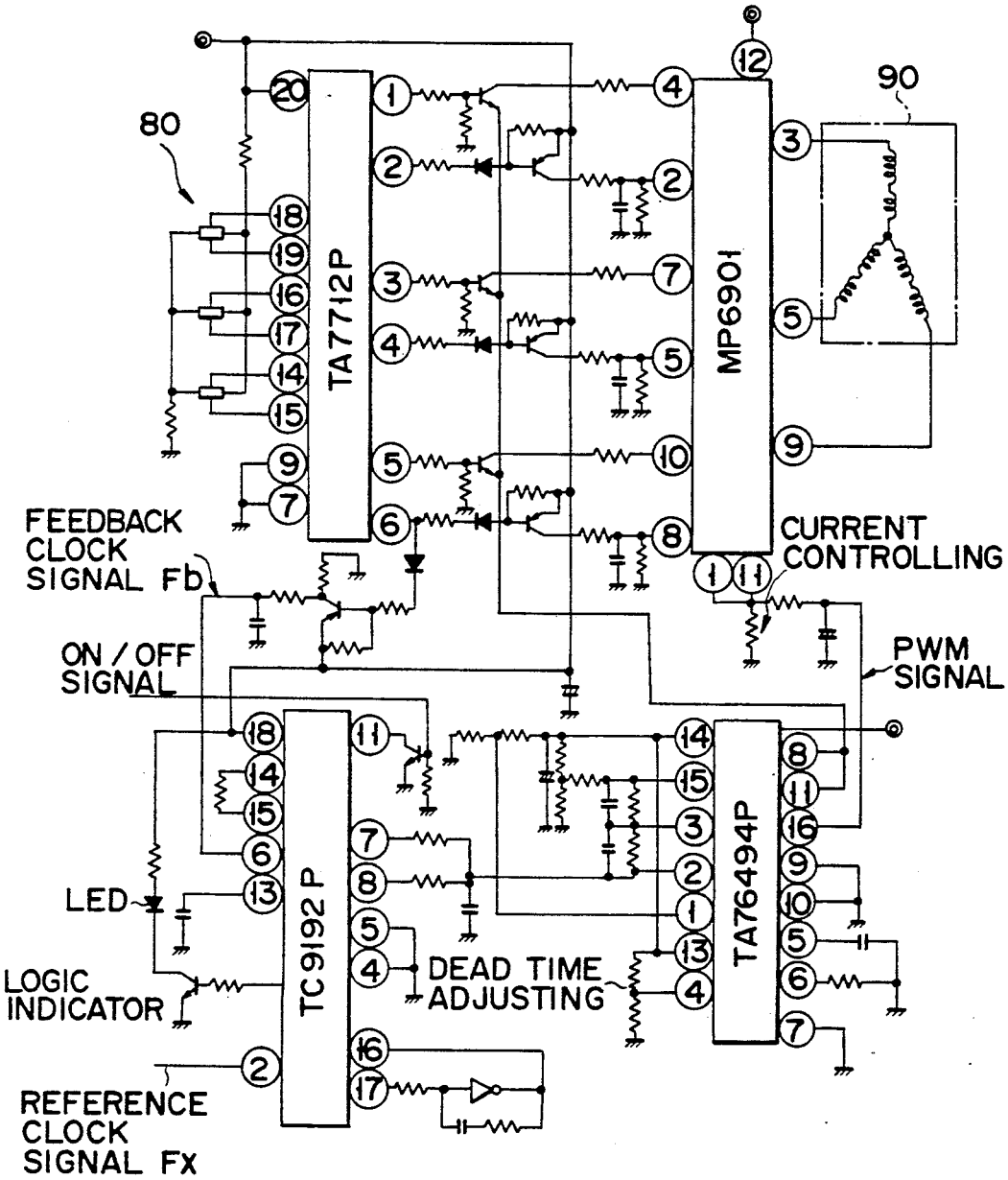
FIG. 10 is a circuit diagram showing the fan-motor driving circuit incorporated in the control system shown in FIG. 9.

FIG. 10 is a circuit diagram schematically illustrating an arrangement of a fan-motor driving circuit 80 in the second embodiment. The driving circuit 80 receives the on/off signal and the reference clock signal Fx, both supplied from the main control section 70. When the on/off signal is at a on-level, the driving circuit 80 drives the fan motor 90. At the same time, the double PLL IC, TC 9192P, controls the fan motor 90 such that the cooing fan 29 is rotated at the rotational speed proportional to the frequency of the reference clock signal Fx. For example, the fan motor 90 is controlled so as to rotate the cooling fan 29 at a speed ranging from 600 rpm to 2400 rpm.

Figure 11:
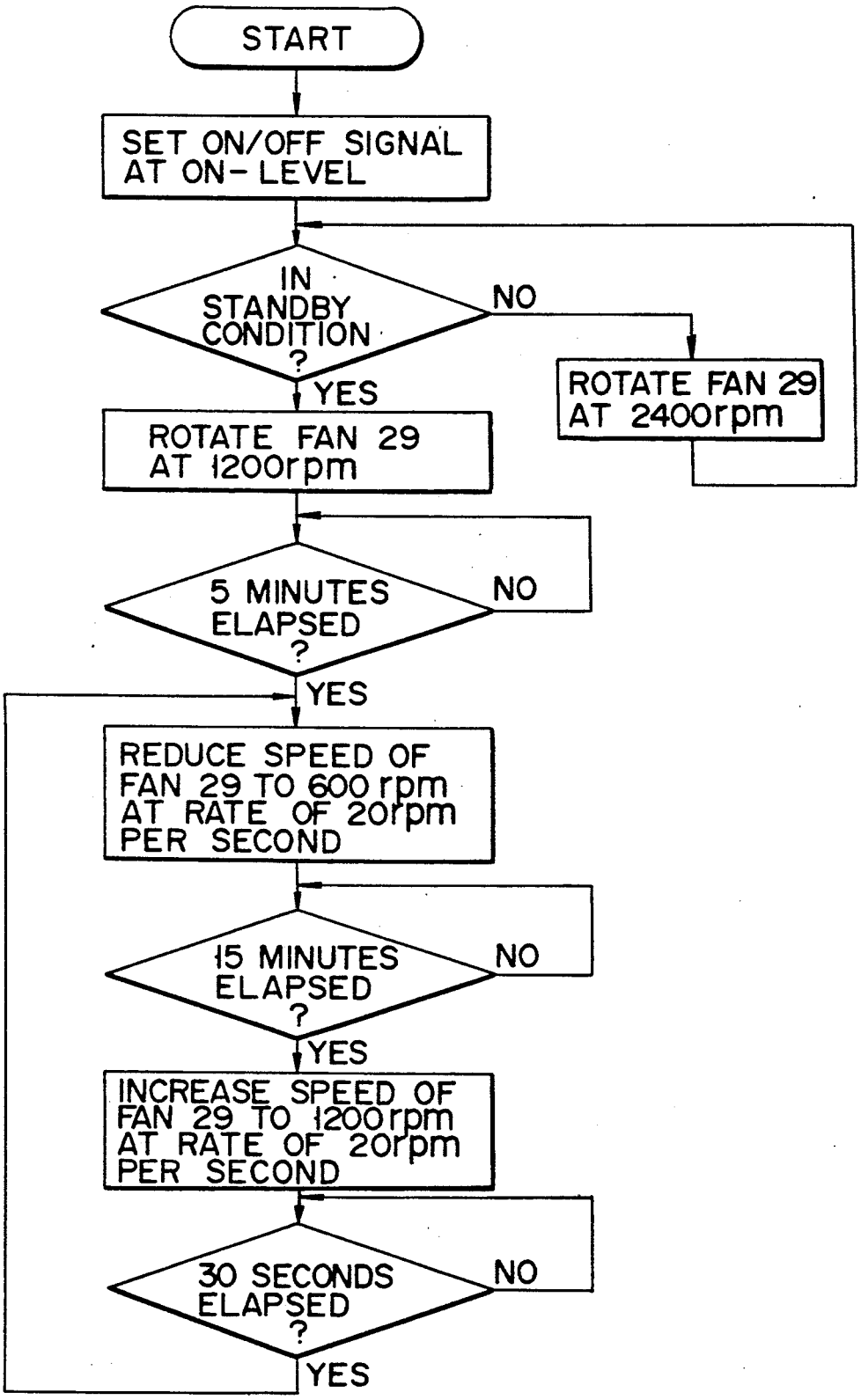
FIG. 11 is a flow chart explaining the operation of the control system shown in FIG. 9.
Figure 12:
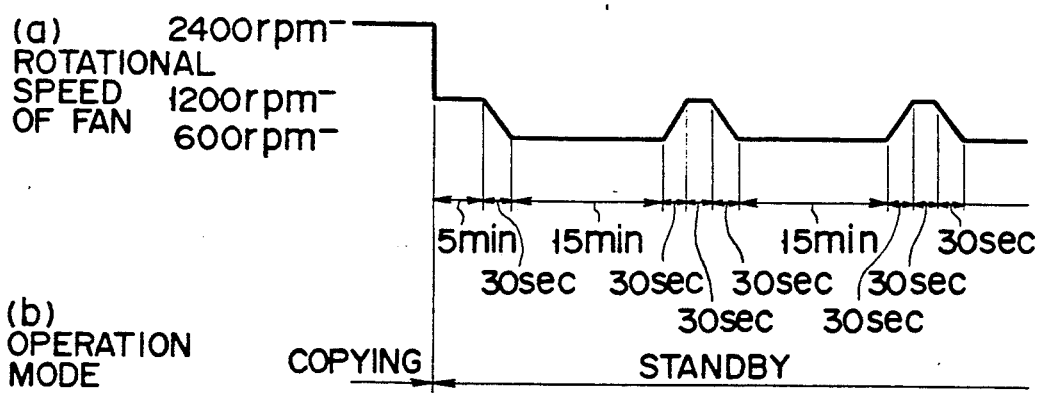
FIG. 12 is a timing chart, also explaining the operation of the control system shown in FIG. 9.

With reference to the flow chart and the timing chart illustrated in FIGS. 11 and 12, it will be explained how the fan 29 is controlled in the electronic copying apparatus according to the second embodiment of the invention. When the main body 1 of the copying apparatus is during copying operation, the main control section 70 sets the on/off signal at the on-level. The frequency of the reference clock signal Fx is set such that the fan motor 90 drives the cooling fan 29 at the speed of 2400 rpm. The on/off signal and the reference clock signal Fx are supplied to the fan-motor driving circuit 80 so that the fan motor 90 is rotated at the rotational speed in accordance with the reference clock signal Fx. Hence, as is evident from FIG. 12, the cooling fan 29 operates at its maximum efficiency during the copying operation.

When the main control section 70 determines that the copying apparatus has completed the copying operation, it sets the frequency of the reference clock signal Fx such that the fan motor 90 drives the cooling fan 29 at a speed of 1200 rpm. As a result, as shown in FIG. 12, when the temperature of the main body 1 is higher than the normal temperature during the standby period immediately after the completion of the copying operation, the cooling fan 29 is rotated at the speed of 1200 rpm for a predetermined time of, for example, 5 minutes, until the temperature within the main body 1 falls to the normal temperature for the standby condition.

Upon lapse of 5 minutes after the completion of the copying operation, the main control section 70 gradually decreases the frequency of the reference clock signal Fx, such that the rotational speed of the cooling fan 29 decreases at the rate of 20 rpm per second, until the rotational speed is reduced to 600 rpm. The rotational speed of the fan motor 90 is therefore lowered gradually by the fan-motor driving circuit 80. As a result of this, as shown in FIG. 12, the speed of the cooling fan 29 is gradually reduced from 1200 rpm to 600 rpm if the temperature within the main body 1 has decreased to the normal temperature for the standby condition during the standby period. Thereafter, the cooling fan 29 is rotated at the speed of 600 rpm.

While the main body 1 of the copying apparatus is in the standby condition for a long period of time, that is, the cooling fan 29 is rotated at the speed of 600 rpm for a long period of time, the rotational speed of the fan motor 90 is changed gradually such that the cooling fan 29 is rotated, for example, at the speed of 1200 rpm for 30 seconds every 15 minutes.

In order to lower periodically the temperature within the main body 1 which will gradually rise during the standby period, the main control section 70 gradually increases the frequency of the reference clock signal Fx such that the rotational speed of the cooling fan 29 increases from 600 rpm to 1200 rpm at the rate of 20 rpm per second upon lapse of 15 minutes. Then, upon lapse of 30 seconds during which time the fan 29 is rotating at 1200 rpm, the main control section 70 gradually decreases the frequency of the reference clock signal Fx such that the rotational speed of the cooling fan 29 decreases from 1200 rpm to 600 rpm at the rate of 20 rpm per second. As a result, as shown in FIG. 12, as long as the copying apparatus remains in the standby condition and the temperature within the main body 1 is the normal temperature for the standby condition, the main control section 70 repeatedly increases and decreases the frequency of the reference clock signal Fx in the same way as described in the preceding paragraph, as is illustrated in the timing chart of FIG. 12. In such case, since the rotational speed of the fan 29 is gradually changed while the apparatus is in the standby condition, the people who use the copying apparatus are unlikely to notice changes in the amount of noise the cooling fan 29 makes.

With the copying apparatus according to the second embodiment described above, it is possible to change the rotational speed of the cooling fan 29 gradually while the apparatus is in the standby condition for a long period of time. Hence, an auditory unpleasant feeling which is caused by the noise made by the abrupt rotation of the cooling fan 29 in the previous first embodiment can be overcome. Further, in this second embodiment, since the cooling fan 29 is rotated at a speed as low as 600 rpm while the temperature within the main body 1 is the normal temperature for the standby condition, the noise made by such rotational speed of the fan 29 during the standby period of the apparatus is sufficiently small, cooling capacity needed at such rotational speed is relatively small, and the rotational speed of the fan 29 need not be so abruptly increased at the start of a copying operation as in the case the fan motor 90 is stopped while the apparatus is in the standby condition.

A third embodiment of the present invention will now be described with reference to FIGS. 13 to 15.

Figure 13:
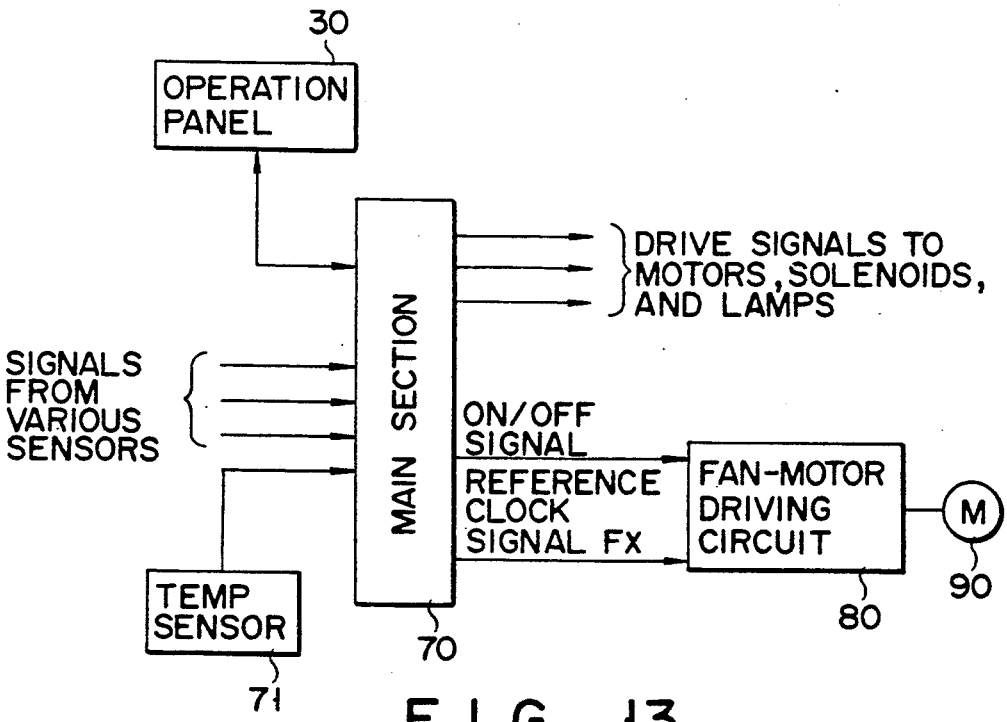
FIG. 13 is a block diagram showing the major components of the control system incorporated in an electronic copying apparatus according to a third embodiment of the present invention.

FIG. 13 is a block diagram schematically illustrating a main portion of a control system used in this third embodiment. As is shown in FIG. 13, this control system is identical to that incorporated in the apparatus shown in FIG. 9, except that it includes a temperature sensor 71 for detecting the temperature within the main body 1 of the apparatus. The temperature within the main body 1 varies according to the changes in the surrounding environment where the main body 1 of the copying apparatus is arranged. In accordance with the temperature the sensor 71 detects, the main control section 70 changes the frequency of the reference clock signal Fx supplied to the fan-motor driving circuit 80, thereby changing the rotational speed of the cooling fan 29.

Figure 14:
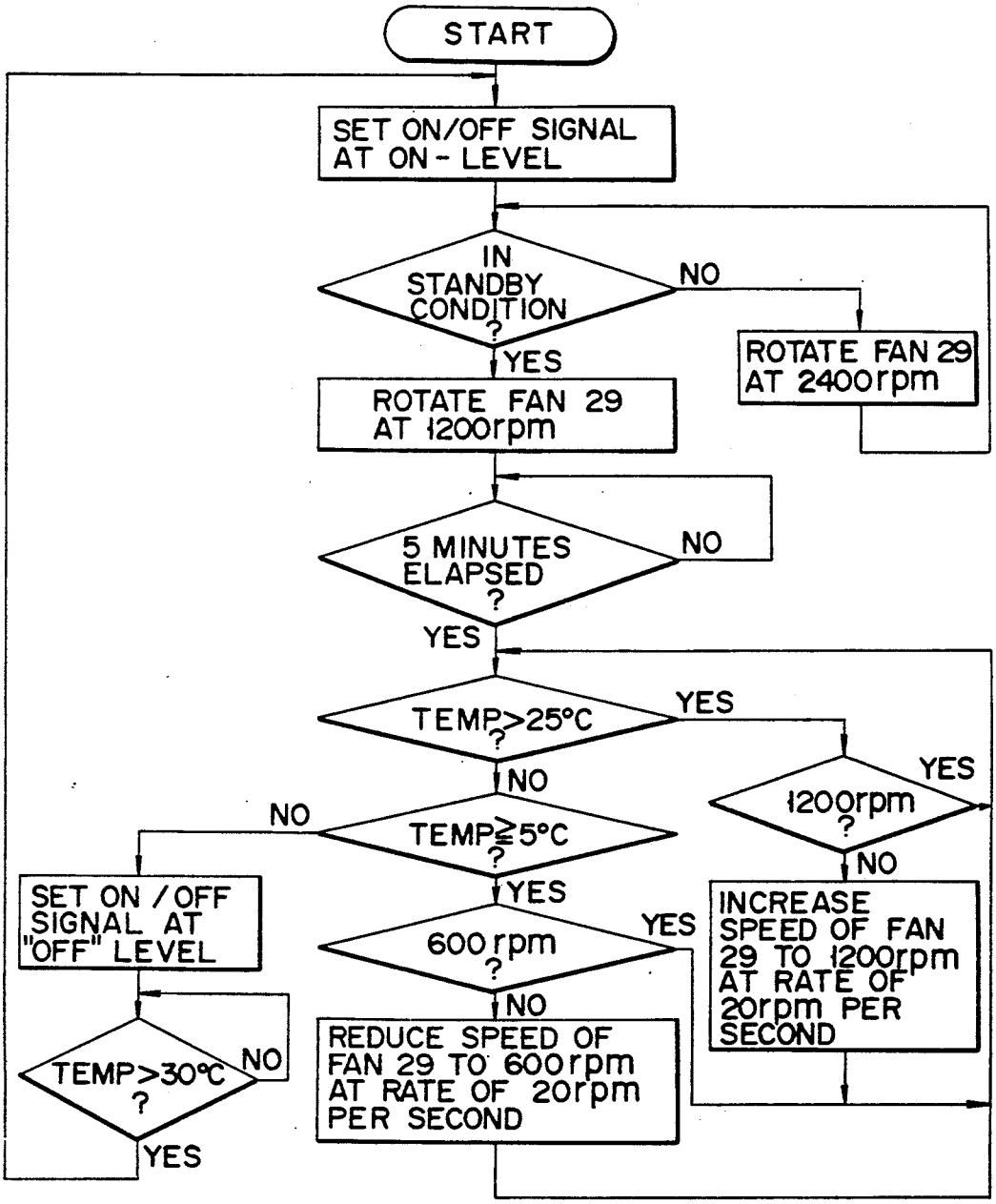
FIG. 14 is a flow chart explaining the operation of the control system shown in FIG. 13.
Figure 15:
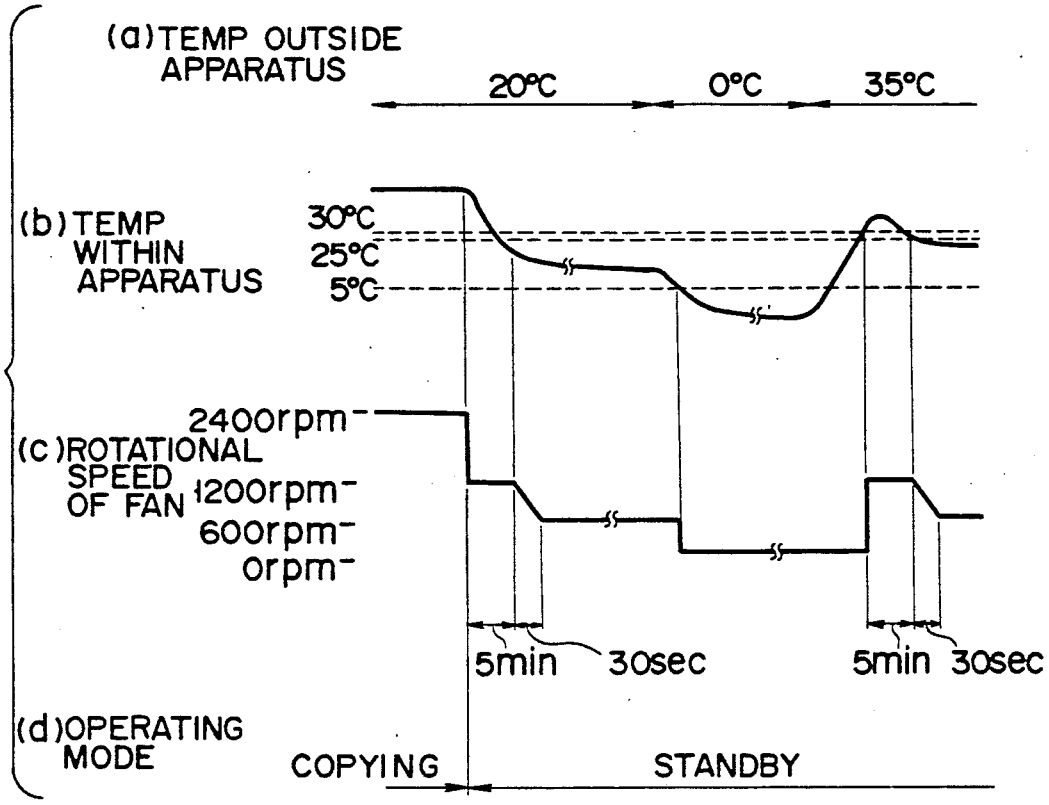
FIG. 15 is a timing chart, also explaining the operation of the control system shown in FIG. 13.

With reference to FIGS. 14 and 15, it will now be explained how the control system shown in FIG. 13 controls the cooling fan 29. When the main body 1 of the copying apparatus is in the copying condition, the main control section 70 sets the on/off signal at the on-level and increases the frequency of the reference clock signal Fx such that the fan motor 90 drives the cooling fan 29 at the speed of 2400 rpm. When the on/off signal and the clock signal Fx are supplied to the fan-motor driving circuit 80. The circuit 80 drives the fan motor 90 at the rotational speed in accordance with the frequency of the reference clock signal Fx. As a result, the cooling fan 29 is rotated at the speed of 2400 rpm and operates at its maximum efficiency during the copying operation, as is evident from FIG. 15.

When the main control section 70 determines that copying operation, it decreases the frequency of the reference clock signal Fx such that the fan motor 90 drives the cooling fan 29 at the speed of 1200 rpm. The reference clock signal Fx is supplied to the fan-motor driving circuit 80. The circuit 80 drives the fan motor 90 at the rotational speed in response to the frequency of the reference clock signal Fx. Hence, as shown in FIG. 15, the cooling fan 29 is rotated at 1200 rpm for a predetermined time of, for example, 5 minutes during the standby period and immediately after the completion of the copying operation until the temperature within the main body 1 falls to the normal temperature for the standby condition.

Upon lapse of 5 minutes during which time the cooling fan 29 is rotating at the speed of 1200 rpm, the main control section 70 starts controlling the fan-motor driving circuit 80 in accordance with the temperature detected by the temperature sensor 71. To be more specific, when the temperature detected by the sensor 71 is within the normal temperature range (5° C. to 25° C.), the rotational speed of the cooling fan 29 is lowered from 1200 RPM to 600 RPM within 30 seconds, and then the cooling fan 29 is rotated at the speed of 600 rpm. When the temperature is lower than the low temperature (5° C.), the control section 70 controls the circuit 80 such that the cooling fan 29 is stopped, and no air is introduced into main body 1. When the temperature rises to the high temperature (30° C. or more), the control section 70 controls the fan-motor driving circuit 80 such that the cooling fan 29 is rotated at the speed of 1200 rpm for a predetermined period of time, e.g., 5 minutes, whereby the temperature within the main body 1 falls fast.

With the copying apparatus according to the third embodiment, the rotational speed of the cooling fan 29 is changed in accordance with the temperature within the main body 1, which the temperature sensor 71 has detected. The temperature can therefore be controlled more reliably than in the apparatuses according to the first and second embodiments. Further, since the rotational speed of the fan 29 is changed gradually as in the second embodiment, the noise made by the fan 29 increasing and decreasing gradually and is, therefore, not a great annoyance to those who use the copying apparatus. Moreover, since the cooling fan 29 is stopped when the sensor 71 detects that the temperature within main body 1 is lower than 5° C., the fan 29 does not introduce cold air into the main body 1, and no condensation is formed on the heat-generating components of the copying apparatus.

All embodiments described above are electronic copying apparatuses. Nevertheless, the present invention is not limited to electronic copying apparatuses. It can be applied to, for example, other types of image forming apparatuses, which have a cooling fan.

As been described above, the present invention can provide an image forming apparatus having a cooling fan, in which the rotational speed of the fan is not constant, but is changed while the apparatus is in a standby condition, and the cooling fan makes but a little noise, without causing a decrease in the operating efficiency of the apparatus which may result from a temperature rise within the apparatus.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus for forming image information obtained by reading an image of an original, said apparatus comprising:

means for cooling heat-generating components;

means for driving said cooling means; and means, whereby the drive means is controlled, for driving said cooling means at a first rotational speed during an image forming period, to drive said cooling means at a second rotational speed for a predetermined time during a standby period, and after said predetermined time has elapsed to drive said cooling means at the second rotational speed for a specific period and to stop said cooling means for another specific period periodically and repeatedly during a standby period.

2. The apparatus of claim 1, wherein the first rotational speed is greater than the second rotational speed.

3. An image forming apparatus comprising:

means for forming image information obtained by reading an image of an original, said image forming means having heat-generating components for generating heat during an image forming period;

means for cooling said heat-generating components;

means for driving said cooling means; and means, whereby the drive means is controlled, for driving said cooling means at a first rotational speed during said image forming period, and to change the rotational speed of said cooling means gradually between a second rotational speed and a third rotational speed at a specific time intervals during a standby period, after a predetermined time has elapsed from the completion of an image forming operation.

4. An image forming apparatus comprising:

means for forming image information obtained by reading an image of an original, said image forming means having heat-generating components for generating heat during an image forming period;

means for cooling said heat-generating components;

means for driving said cooling means;

means for detecting the temperature within said apparatus; and means, whereby the drive means is controlled, for driving said cooling means at a first rotational speed during said image forming period, and to change the rotational speed of said cooling means gradually between a second rotational speed and a third rotational speed during a standby period in response to the temperature detected by said detecting means.

5. An image forming apparatus having a thermal source for generating heat, said apparatus comprising:

means for expelling the heat from said apparatus;

first detecting means for detecting the image forming operation by said apparatus;

second detecting means for detecting the temperature within said apparatus;

means for energizing said expelling means corresponding to the temperature detected by said second detecting means, to decrease the rotational speed of said expelling means during a standby period when said second detecting means detects that the temperature with the apparatus falls below a predetermined temperature; and means, responsive to said first detecting means, for controlling said expelling means so as to expel the heat from said apparatus irrespective of said second detecting means.

* * * * *